US006379271B1

(12) United States Patent
Arnke

(10) Patent No.: US 6,379,271 B1
(45) Date of Patent: Apr. 30, 2002

(54) GOLF ACCESSORY

(76) Inventor: Michael C. Arnke, 8401 Justine Ct., Las Vegas, NV (US) 89128

( * ) Notice: Subject to any disclaimer, the term of this patent is extended or adjusted under 35 U.S.C. 154(b) by 0 days.

(21) Appl. No.: 09/506,490

(22) Filed: Feb. 18, 2000

Related U.S. Application Data

(60) Provisional application No. 60/126,323, filed on Mar. 26, 1999.

(51) Int. Cl.[7] ..... A63B 57/00; B41F 17/00

(52) U.S. Cl. ..... 473/406; 101/DIG. 40

(58) Field of Search ..... 473/406, 408, 473/285; D19/42, 43, 82; 224/918; 101/DIG. 40

(56) References Cited

U.S. PATENT DOCUMENTS

| | | | | | |
|---|---|---|---|---|---|
| D155,152 | S | * | 9/1949 | Greenstein et al. | D19/42 |
| 3,415,518 | A | * | 12/1968 | Root | 473/406 |
| 3,615,596 | A | | 10/1971 | Petti et al. | |
| 3,961,852 | A | | 6/1976 | Parry | |
| 4,302,121 | A | | 11/1981 | Kim | |
| D304,607 | S | | 11/1989 | Bagg | |
| 4,893,818 | A | * | 1/1990 | Liccardello | 473/396 |
| D317,624 | S | | 6/1991 | Jurinjak | |
| D319,466 | S | | 8/1991 | Summers | |
| D352,069 | S | | 11/1994 | Doolin | |
| D357,500 | S | | 4/1995 | Mutterperl | |
| D393,280 | S | | 4/1998 | Cheng | |
| 5,735,544 | A | | 4/1998 | Buckner | |
| 5,743,180 | A | | 4/1998 | Arnke | |
| 6,050,905 | A | * | 4/2000 | Tate | 473/408 |
| 6,149,333 | A | * | 11/2000 | Kershaw | 401/98 |
| 6,224,501 | B1 | * | 5/2001 | Rudduck et al. | 473/401 |
| D447,172 | S | * | 8/2001 | Cohen | D19/42 |

* cited by examiner

*Primary Examiner*—Steven Wong
(74) *Attorney, Agent, or Firm*—Richard C. Litman

(57) ABSTRACT

A golf accessory combines a marking pen for players to place identification on their golf balls, and a green marker for marking the position of a golf ball on a golf green. The present accessory has a configuration resembling a golf tee with a golf ball resting thereon, with the appearance or configuration providing ready recognition of the present device as being related to the game of golf, as well as providing a convenient configuration for the apparatus of the accessory. The elongate tee portion of the device serves as a marking pen, with the marker tip being removably capped by the golf ball shaped portion at the marker tip end of the tee. The opposite end of the tee may include a diametric passage therethrough for attaching a keychain or the like, or for attachment to a golf bag, etc. as desired. The golf ball shaped portion serves as a removable cap for the marker tip, and is openable along a hemispherical parting line to access the interior thereof. A green marker for marking the location of a golf ball on a golf green, may be removably stored within the openable golf ball shaped portion of the present accessory.

8 Claims, 3 Drawing Sheets

GOLF ACCESSORY

REFERENCE TO RELATED PATENT APPLICATION

This application claims the benefit of U.S. Provisional Patent Application Serial No. 60/126,323, filed on Mar. 26, 1999.

BACKGROUND OF THE INVENTION

1. Field of the Invention

The present invention relates generally to sports equipment and accessories, and more specifically to a golf accessory in the general configuration of a key chain attachment. The present golf accessory includes a marking pen with a cap which includes a golf ball marker removably stored therein.

2. Description of the Related Art

The game of golf has become extremely popular throughout the world, and its popularity continues to increase. As a result, courses are becoming increasingly crowded, with perhaps several players in a group playing on any given hole obviously, it can be difficult for each player to keep track of his or her golf ball while it is in play, under such circumstances.

Accordingly, the rules of golf require that each player be able to identify his or her ball while it is in play, in order to avoid playing the wrong ball and suffering the corresponding penalty. The identification is generally accomplished by the golfer marking the ball with a suitable marker of some sort, to produce a distinctive signature, mark, ink color, etc. to differentiate that player's ball from others in play. However, it has been found that most golfers do not bother to mark their golf balls, most likely because the golfer forgets to take care of this chore before play begins, and the lack of a suitable marking means being available on the course.

Aside from the importance of marking one's ball for identification during play, it is also required that players mark the location of their ball in the event the ball is temporarily removed from play, as in providing a clear line to the hole for another player on a golf green. Ball markers of various sorts have been developed for this purpose, with the golfer merely placing the marker in the surface of the green at the location of his or her ball, and then replacing the ball at that position when that player's turn comes up. Practically all golfers carry such markers, either in the form of a specialized and/or personalized, ornamental device, or in a less expensive generic form. In any event, such markers are generally carried loose in a clothing pocket, or in a pocket of a golf bag, etc., where the golfer must rummage around to access the relatively small marker.

Accordingly, a need will be seen for a golf accessory comprising a combination marking pen for marking golf balls with appropriate player identification, and a holder for a golf ball position marker. The present invention has the general configuration of an enlarged golf tee, both for the novelty of the appearance and also to clearly identify the device as a golf accessory. The marker pen is preferably in the form of a fiber tip marker and forms the stem of the simulated tee, with the cap of the pen having the appearance of a golf ball resting on the tee. The generally spherical cap is removable from the tip of the pen, for using the pen. The cap is openable along a hemispherical parting line to access the golf ball position marker stored therein. The distal tip of the pen may include a key chain passage therethrough, so the device may be used as a key chain holder for locker and/or golf cart keys, etc. as desired.

A discussion of the related art of which the present inventor is aware, and its differences and distinctions from the present invention, is provided below.

U.S. Pat. No. 3,615,596 issued on Oct. 26, 1971 to Albert F. Petti et al., titled "Writing Accessory," describes a generally hollow tube for removably fitting a pencil or the like therein, with an opposite closed end of the tube having a hard candy (e.g., lollipop) molded in place thereon. No cap is disclosed for covering the tip of the pencil or marker held in the Petti et al. device, whereas the present golf accessory includes such a removable cap for preventing the marker tip from drying out. The generally round candy element on the Petti et al. device is not hollow and cannot be opened or used for storing anything therein, whereas the hollow sphere of the present accessory may be opened to access a golf ball position marker stored therein. Moreover, the round element of the Petti et al. device cannot be removed from the tube or rod element, except by ingesting the element, whereas none of the components of the present invention are edible and the spherical element is readily removable.

U.S. Pat. No. 3,961,852 issued on Jun. 8, 1976 to David W. Parry, titled "Writing Instrument," describes an accessory for a pen or the like, comprising a cap with a flat plate formed along one side thereof. The plate may be used as a writing surface, and/or may include a plurality of sheets of paper therewith, and may include other features and functions as well. While Parry discloses a pen having a conventional breather vent therein, as provided in the marker element of the present golf accessory, he does not disclose any form of removable spherical cap, much less any means of opening the cap to access a golf ball position marker or other accessory stored therein, as provided by the present golf accessory.

U.S. Pat. No. 4,302,121 issued on Nov. 24, 1981 to Jung S. Kim, titled "Ball-Point Pen Having Three Sides And Complementary Cap," describes a pen having a generally equilateral triangular cross section, with concave sides. The cap disclosed by Kim is not: spherical, is not hollow, cannot be opened, and cannot store a ball position marker therein, whereas each of the above features is provided by the present golf accessory.

U.S. Pat. No. 5,735,544 issued on Apr. 7, 1998 to Jennifer L. Buckner, titled "Page Turning Device," describes a generally spherical device having a multitude of small protuberances evenly disposed over the surface thereof, for gripping the surface of a sheet of paper for turning the page. The protuberances are the exact opposite of the dimples formed in the surface of a golf ball, which the cap of the present accessory resembles. Moreover, the Buckner page turner is a solid mass, with the exception of a socket for removably installing the device on the end of a pencil or the like. Buckner does not provide a hollow interior, openable shell, nor storage means therein for a golf ball position marker, each of which features are a part of the present golf ball accessory. Also, it should be noted that the Buckner device is formed of a soft, moldable rubber material (column 3, lines 54–55), which would be unsuitable for forming a relatively rigid hollow cap as required by the present invention.

U.S. Pat. No. 5,743,180 issued on Apr. 28, 1998 to Michael C. Arnke, titled "Golf Ball Marker," describes a device having a superficial resemblance to the present invention, but incorporating a completely different structure and function. The device of the Arnke '180 U.S. Patent resembles a golf tee with a ball resting thereon, but the stem portion of the tee does not include any form of marking or writing implement therein, as does the present invention. In lieu of such a marking implement, the Arnke '180 U.S. Patent device includes an ink pad and stamp housed in an openable shell, resembling a golf ball resting atop the tee. The hollow golf ball shape is similar to that of the present invention, but due to its containing of the ink pad and stamp therein, cannot contain a golf ball position marker therein, as can the present golf accessory invention. Also, the entire golf ball cap portion of the present invention acts as a cap for the marker pen portion, and is completely removable therefrom, unlike the golf ball portion of the device of the Arnke '180 U.S. Pat.

U.S. Pat. No. D-304,607 issued on Nov. 14, 1989 to Robert D. Bagg, titled "Golf Tee," illustrates a design for a golf tee having a relatively wide flange disposed immediately below the ball rest at the end of the tee. No marking means, removable components, or ball location marker storage means is apparent in the Bagg design.

U.S. Pat. No. D-317,624 issued on Jun. 18, 1991 to William R. Jurinjak, titled "Combined Pen And Magnetic Holder Therefor," illustrates a design comprising a base with an apparently magnetic object resembling a golf ball suspended thereabove by a wire. A pen generally resembling a golf tee is shown being held generally vertically, apparently by the magnetic force developed by the golf ball shaped component. No means of opening the golf ball component, or separating it from its wire holder for use as a cap for the pen, nor for storing a ball position marker therein, are apparent in the Jurinjak design.

U.S. Pat. No. D-319,466 issued on Aug. 17, 1991 to James A. Summers, titled "Writing Instrument," illustrates a design comprising a pen with a flattened upper portion and flattened circular component resembling a side view of a golf ball, resting thereon. The assembly thus loosely resembles a golf tee with a ball resting thereon, when viewed fully from the side, as opposed to an edge view. No means of removing the golf ball from the pen, nor for storing any articles within any portion of the design, is apparent in the Summers design.

U.S. Pat. No. D-352,069 issued on Nov. 1, 1994 to Patrick R. Doolin, titled "Combined Clock, Writing Instrument And Holder Therefor," illustrates a design comprising a generally flat base with a golf ball shaped clock housing at one end and an elongate article resembling a golf tee at the opposite end. The elongate article is apparently a pen, according to the title and claim of the patent, but no means is apparent for removing the golf ball shaped clock housing from the base for installing it on the pen or tee for use as a cap, nor for opening the ball shaped housing for storing and accessing a golf ball position marker or other accessory therein, which features are provided by the present: golf accessory invention.

U.S. Pat. No. D-357,500 issued on Apr. 18, 1995 to Charles H. Mutterperl, titled "Combined Pen And Sports Ball Holder Therefor," illustrates a series of designs each having an elongate cylindrical article extending from a representation of a sports ball of some sort. A cord extends from the sports ball representation, opposite the cylinder. One of the balls represented, has the appearance of a golf ball. No means is apparent for opening the ball portion for storing or accessing any article therein, nor for removing the ball portion from the cylindrical portion of the design, which features are provided by the present golf accessory invention.

Finally, U.S. Pat. No. D-393,280 issued on Apr. 7, 1998 to Chang-Ming Cheng, titled "Combined Writing Instrument And Roll-Out Map," illustrates a design including a pen having a removable cap resembling a golf club head. No openable spherical storage compartment for a golf ball position marker is provided in the Cheng design, whereas the present golf accessory invention includes such a configuration.

None of the above inventions and patents, taken either singly or in combination, is seen to describe the instant invention as claimed.

SUMMARY OF THE INVENTION

The present invention comprises a golf accessory having a marking pen for placing identification on a golf ball, and also including storage for a ball position marker for marking the position of a golf ball on a golf green. The present golf accessory is configured to resemble a golf tee with a golf ball resting thereon, in its assembled and closed state. The elongate tee portion serves as the marking pen portion of the device, with the tip of the tee portion opposite the marker tip including a key chain passage therethrough. The marker tip is protected by a removable cover configured like a golf ball. The cover may be opened along a hemispherical parting line to access a golf ball green position marker which may be stored in the upper portion of the cover, i.e., the portion not directly engaging the marker pen Accordingly, it is a principal object of the invention to provide an improved golf accessory comprising a combination device for providing identification marking on a golf ball, and also for marking the position of a golf ball on a golf green.

It is another object of the invention to provide an improved golf accessory having a configuration resembling that of a golf tee with a golf ball resting thereon.

It is a further object of the invention to provide an improved golf accessory which elongate tee portion comprises a marking pen, for marking identification on a golf ball.

Yet another object of the invention is to provide an improved golf accessory which tip of the tee portion opposite the marker tip, includes a diametric attachment passage therethrough.

An additional object of the invention is to provide an improved golf accessory which golf ball shaped portion serves as a removably installable cap for protecting the tip of the marker.

Still another object of the invention is to provide an improved golf accessory which golf ball portion is openable along a generally hemispherical parting line, for accessing a golf ball green marker removably stored therein.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
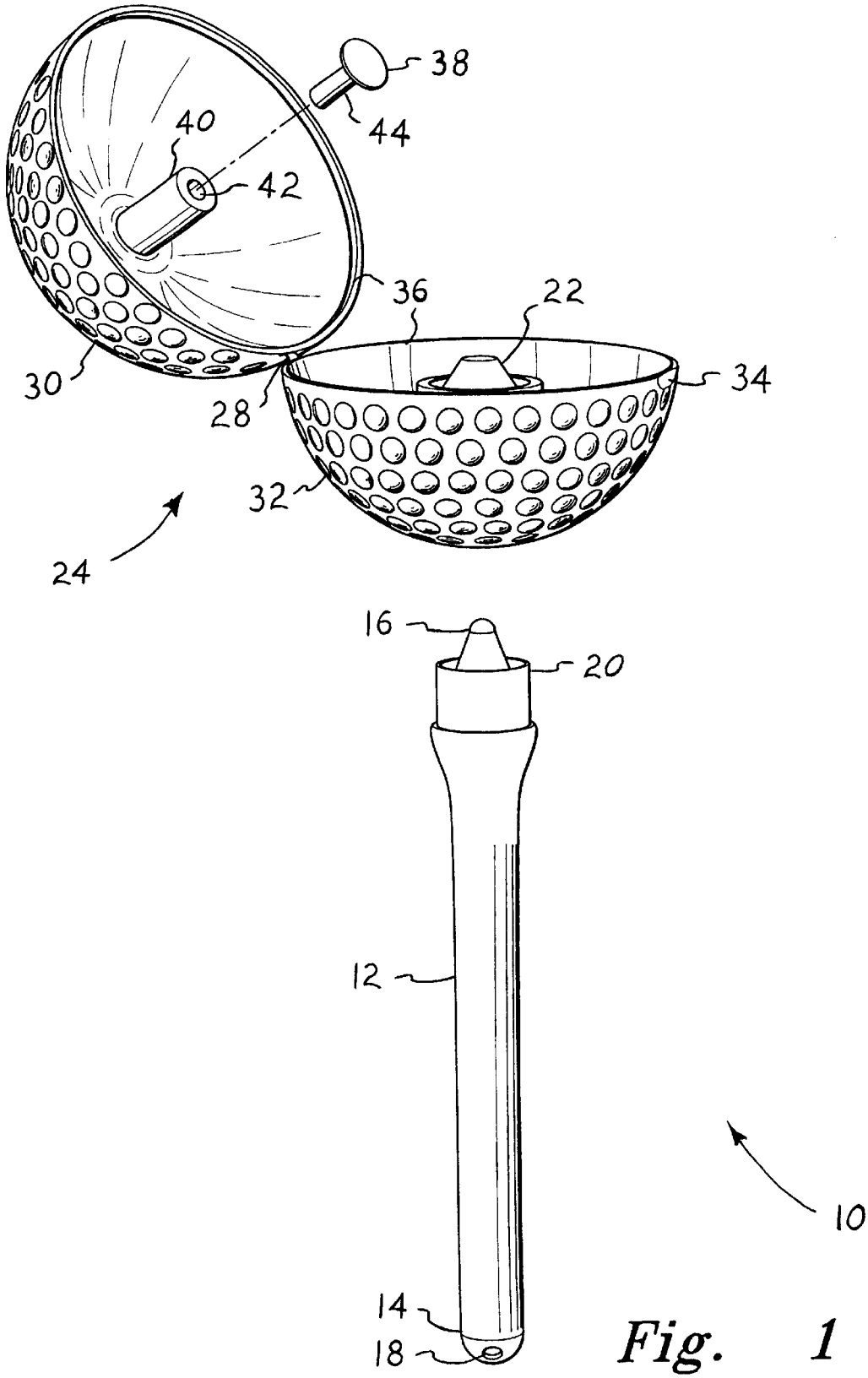
FIG. 1 is an exploded perspective view of the present golf accessory, showing its various features.

The present invention is a golf accessory providing various functions in a single combination device. The basic features of the present accessory 10 are shown in FIG. 1 of the drawings. The accessory 10 is specifically configured to resemble a golf tee with a golf ball resting thereon when the device 10 is assembled. This configuration clearly indicates the general purpose of the present accessory 10 as being closely related to the game of golf, and readily identifies the accessory 10 as a golf accessory or tool to golfers and others involved in the game of golf.

The elongate tee portion 12 of the present accessory 10 comprises a marking pen, for use by a golfer in placing identification marking (initials, etc.) on a golf ball for specific identification of that player's ball during play. The marking pen 12 is preferably a felt tip marker, but other suitable types of marking or writing implements may be provided as desired.

It is important that the ink used, provide the proper characteristics and have the appropriate properties. The ink must be fast drying, waterproof, and permanent. Inks having these properties generally have an alcohol base. Accordingly, the material used to form at least the marking pen barrel 12 must be insoluble in alcohol. A copolymer polypropylene plastic has been found to be suitable, with such a plastic compound also providing good characteristics for molding and forming the various components of the present accessory 10.

Figure 2:
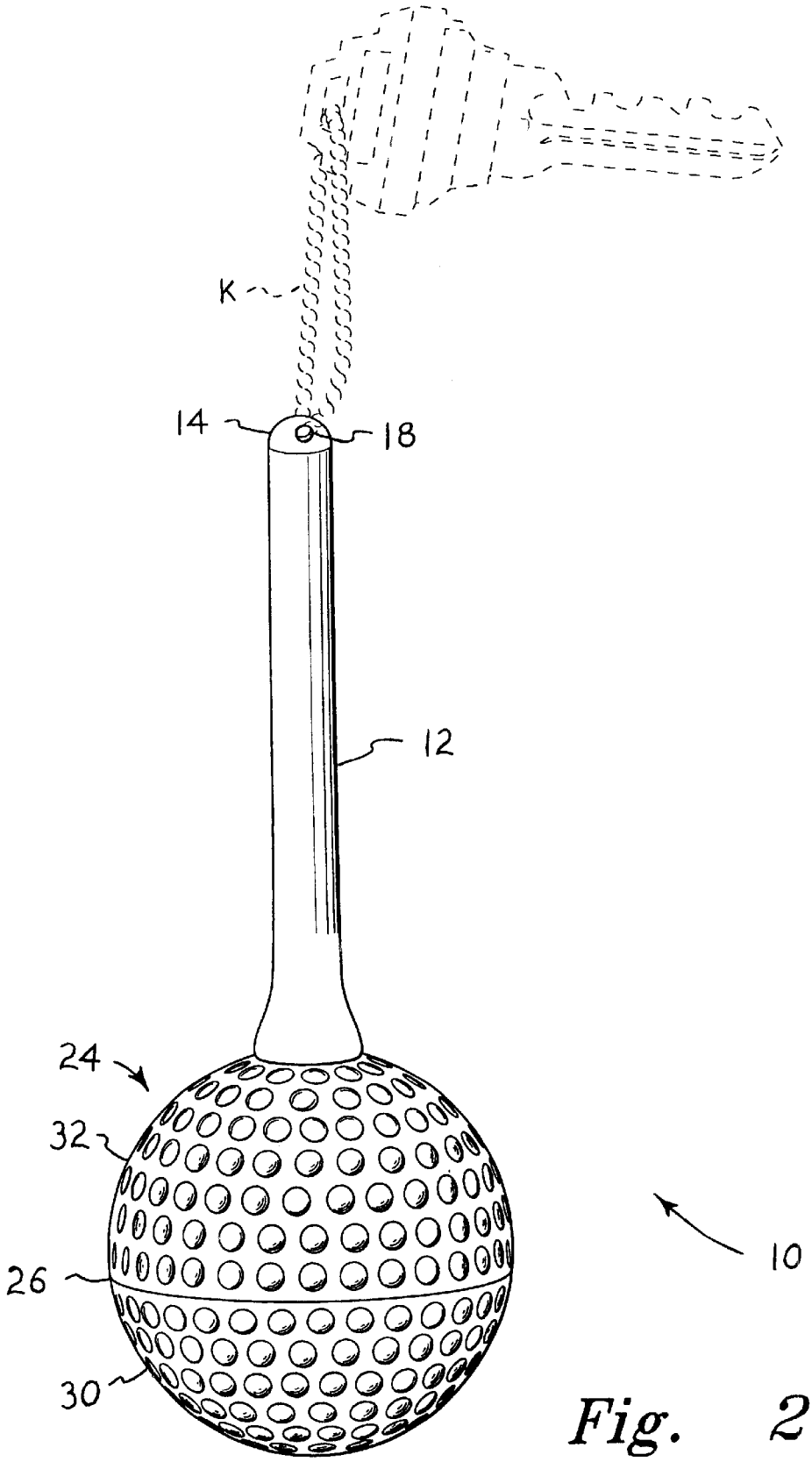
FIG. 2 is a perspective view of the golf accessory, showing the attachment means provided at the distal tip thereof.

The tee-shaped marker pen portion 12 of the device 10 has a distal attachment end 14, i.e., the end opposite the marker tip 16, which may have a friction fit or may alternatively have a snap attachment or be threadedly attached to the rest of the pen barrel 12, as desired. The end 14 includes a generally diametric attachment passage 18 therethrough which may be used to attach the device 10 to a keychain K, as shown in FIG. 2, or for the attachment of a hook, clip, or other suitable attachment device therethrough for removably attaching the present accessory 10 to a golf bag, golf cart, or other article or object as desired.

Figure 3:
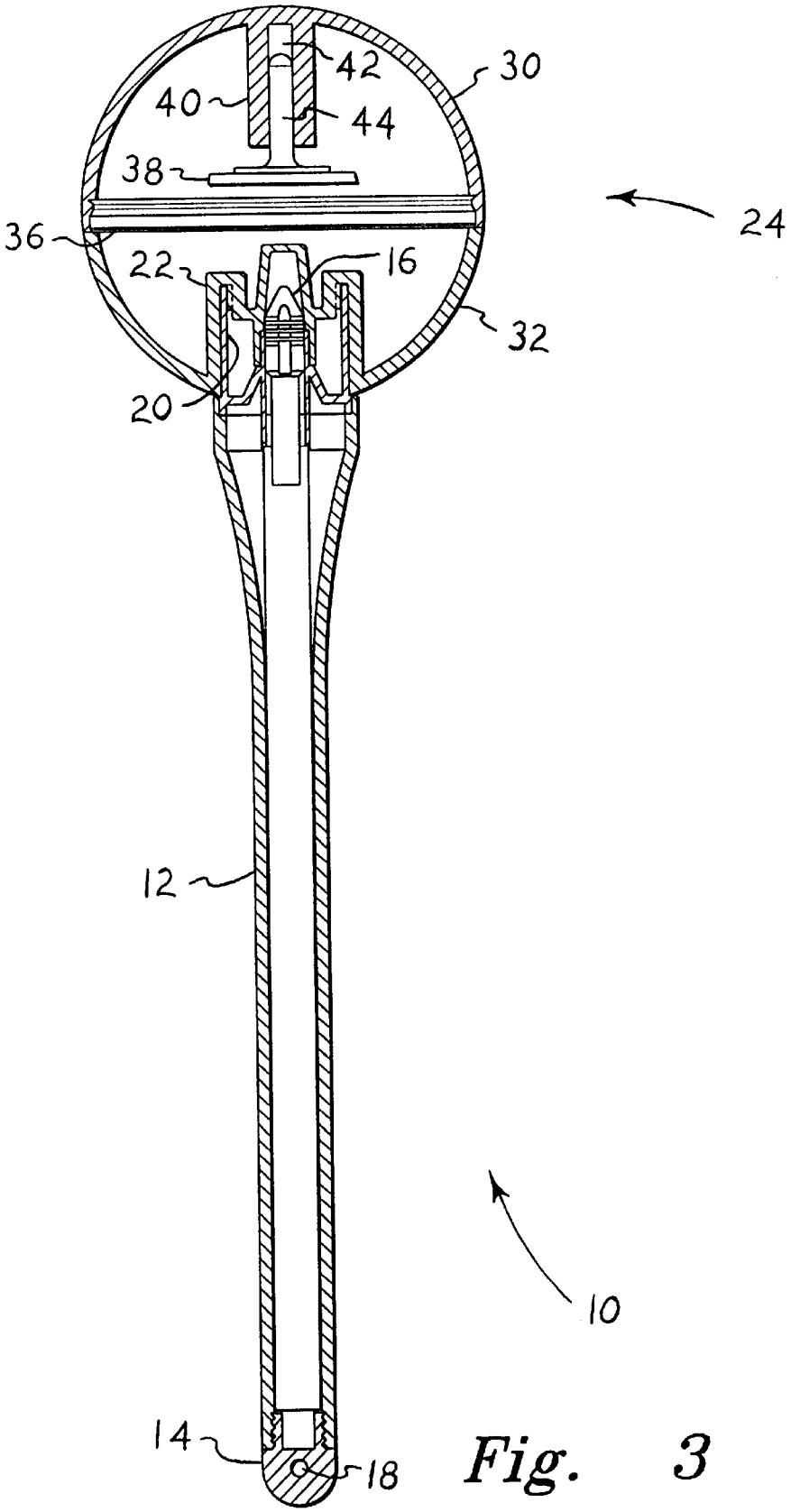
FIG. 3 is an elevation view in section, showing various details of the present golf accessory.

The upper or pen tip 16 end of the marking device 12 includes a collar 20 extending upwardly from the barrel of the pen, for removably securing the cap 22 (more clearly shown in the cross section view of FIG. 3) over the pen tip 16. The cap 22 may secure to the collar 20 of the marker pen 12 by a friction fit, or alternatively may use mutually cooperating threaded attachment means, snap attachment means, etc. as desired.

The cap 22 is contained within and preferably formed integrally with a generally spherical structure 24 resembling a golf ball. The cap assembly 24 is hollow, and is openable along a circumferential closure line 26 defining two cap hemispheres 30 and 32, as shown in FIG. 2. A live hinge 28 secures the two halves 30 and 32 together, opposite a fingernail indentation 34 for opening the two halves 30 and 32 of the cap 24. Mutually engaging lips 36 (more clearly shown in FIG. 3) may be provided for holding the two halves 30 and 32 of the structure 24 closed as desired. Thus, when the two halves 30 and 32 are closed and the cap 24 is placed over the pen tip 16, the assembly 10 closely resembles a conventional golf tee with a golf ball resting thereon.

While the portion 32 of the ball assembly 24 which connects to the marker pen 12 includes the cap 22 for protecting the marker tip 16 when the marker 12 is not in use, the generally hollow upper portion 30 of the ball assembly 24 may provide for the removable storage of a golf ball green marker 38. The upper portion 30 includes a generally cylindrical post 40 extending from the inner wall thereof, which post 40 includes a concentric hollow passage 42 therein. The passage 42 is configured to accept the conventional pin or post 44 of the green marker 38 therein, and may be sized to provide a secure friction fit for the green marker pin 44. However, the green marker 38 cannot escape from its storage position in the closed ball assembly 24, as the marker pen cap 22 is positioned immediately adjacent the green marker 38 to preclude the marker 38 from moving from its storage position in the post 40.

The present golf accessory 10 may be suspended or otherwise stored by means of its attachment passage 18, on a belt loop, zipper pull of a golf bag, etc. as desired, until it is needed. When a golfer has need to place identification on his or her golf ball(s), the golf accessory 10 may be removed from its storage location, the golf ball shaped cap assembly 24 removed from the marker pen collar 20, and the marker pen 12 used to mark the ball(s) as desired. It is not necessary to open the two ball components 30 and 32 to use the marker pen 12. The ball assembly 24, with its integral cap 22, is replaced over the marker tip 16 when use of the marker pen 12 is no longer needed.

When a golfer needs to mark the location of his or her ball temporarily on a golf green, as occurs from time to time in the game, he or she need only flip the upper half 30 of the ball assembly 24 open, to access the green marker 38 stored therein. The green marker 38 is removed from its storage location with its pin 44 held in the passage 42 of the green marker storage post 40, and placed on the green as required. It should be noted that it is not necessary to remove the ball assembly 24 from the pen 12 for accessing the green marker 38. The tip 16 of the pen 12 is thus protected at all times when it is not needed, even if another function of the accessory 10 is needed. When the green marker 38 is no longer needed, it is easily replaced by opening the ball assembly 24 and inserting the pin 44 of the green marker 38 into the receptacle or passage 42 of the green marker storage post 40, and closing the two halves 30 and 32 of the ball assembly 24.

In summary, the present golf accessory provides a much needed tool or device for use by golfers during play. The dual functions of the present accessory provide a notable improvement in efficiency over the need to carry two different articles for placing identification on golf balls, and also for carrying or storing a green marker(s) during a round of golf. Storage space can be critical out on the golf course, with the carriage of various bulky articles on the person being a hindrance to the golfer during play. Storage space is also limited in golf bags, with various articles (spare balls, golf club head covers, towels, ball retrievers, etc.) generally being carried by many golfers. The external attachment means of the present accessory, and the dual function of the device, serve to reduce the encumbrance of the golfer during play.

The resemblance of the present accessory to a golf tee and ball resting thereon, also serves a purpose in that it renders the present accessory readily identifiable as a golfing article, with its general function as a golfing accessory being readily understood by those participating in the game of golf. The present device may be used as an advertising accessory, or may be personalized with the name of the owner, if so desired. Accordingly, it is preferred that the dimpling on the outer surface of the golf ball shaped portion be comparatively shallow, in order to accept stamped indicia or the like thereon. The relatively shallow dimples are advantageous in the injection molding process which is preferred for the manufacture of the present accessory. Accordingly, the present accessory with its dual functions and means for external carriage due to its attachment passage, will find great favor among many golfers.

It is to be understood that the present invention is not limited to the sole embodiment described above, but encompasses any and all embodiments within the scope of the following claims.

I claim:

1. A golf accessory, comprising:

a combination device, including;

a marking pen having a marker tip, for providing identification marking on a golf ball;

a cap for removably covering and protecting said marker tip of said marking pen;

an openable cap removably securable over said marker tip;

a green marker removably stored within said openable cap; and said marking pen having a configuration resembling that of a golf tee and said cap having a configuration resembling that of a golf ball, for readily identifying said device as relating to the game of golf.

2. The golf accessory according to claim 1, wherein:

said marking pen includes a distal end opposite said marker tip, and;

said distal end includes an attachment passage formed therethrough.

3. The golf accessory according to claim 1, wherein:

said marker tip comprises a felt tip marker.

4. The golf accessory according to claim 1, wherein:

said openable cap comprises a first and a second hemispherical portion including a circumferential parting line therebetween; and said first and said second hemispherical portion are at least partially separable about said circumferential parting line.

5. The golf accessory according to claim 4, including:

at least one fingernail indentation disposed along said circumferential parting line, for opening said first and said second hemispherical portion of said openable cap.

6. The golf accessory according to claim 5, including:

live hinge means connecting said first and said second hemispherical portions of said cap, disposed along said circumferential parting line generally diametrically opposite said fingernail indentation.

7. The golf accessory according to claim 1, wherein:

said openable cap is removably secured over said marker tip of said marking pen by friction fit means.

8. The golf accessory according to claim 1, wherein:

at least said marking pen is formed of copolymer polypropylene plastic.

* * * * *